United States Patent [19]

Okamoto et al.

[11] Patent Number: 4,829,190

[45] Date of Patent: May 9, 1989

[54] AUTOMATIC HYDRAULIC CLAMPING MECHANISM FOR A WINDOW FOIL HOLDER OF AN ELECTRON BEAM IRRADIATOR

[75] Inventors: Kenji Okamoto; Takashi Matsumoto, both of Kyoto, Japan

[73] Assignee: Nissin High Voltage Co., Ltd., Kyoto, Japan

[21] Appl. No.: 194,908

[22] Filed: May 17, 1988

[30] Foreign Application Priority Data

May 18, 1987 [JP] Japan ..... 62-120373

[51] Int. Cl.[4] ..... H01J 33/04

[52] U.S. Cl. ..... 250/492.3; 250/503.1; 313/420

[58] Field of Search ..... 250/492.3, 503.1; 313/420

[56] References Cited

U.S. PATENT DOCUMENTS 3,440,466 4/1969 Colvin et al. ..... 250/492.3

4,734,586 3/1988 Crist et al. ..... 250/492.3

*Primary Examiner*—Bruce C. Anderson

*Assistant Examiner*—Jack I. Berman

*Attorney, Agent, or Firm*—Finnegan, Henderson, Farabow, Garrett, Dunner

[57] ABSTRACT

An automatic hydraulic clamping mechanism for a window foil holder of an electron beam irradiator includes a foil holder suspended below a flange at the bottom of a vacuum container. A foil is mounted on the foil holder and hydraulic hanging cylinders are provided at each corner of the holder and are driven to raise the foil holder such that it remains parallel to the flange. Once the foil is raised to be in contact with the flange a plurality of hydraulic clamping cylinders are energized to clamp the foil holder in place.

3 Claims, 3 Drawing Sheets

AUTOMATIC HYDRAULIC CLAMPING MECHANISM FOR A WINDOW FOIL HOLDER OF AN ELECTRON BEAM IRRADIATOR

FIELD OF THE INVENTION

The present invention relates to a mechanism for automatically and hydraulically clamping a window foil holder of an electron beam irradiator.

BACKGROUND OF THE INVENTION

In an electron beam irradiator, an electron beam is generated and accelerated in a high-degree vacuum and is emitted into the atmosphere to irradiate an object with electrons and to cause a chemical reaction therein to change the chemical properties thereof. Although the electron beam irradiator is used for various purposes, it is most often used for polymerization in applications to cross-link an electric insulator that coats an electric wire, a heat-shrinkable tube, formed polyethylene, a rubber tire and so forth. The electron beam irradiator can be used to sterilize medical equipment, process foodstuffs and feedstuffs, denitrate and desulfurize smoke, and harden a liquid resin for coating, printing, lamination, magnetic medium processing, and so forth. The amount of energy of the electron beam is expressed by the acceleration voltage, which is commonly about 100 kV to 10,000 kV, and differs depending on the purpose of the irradiation by the electron beam. The amount of energy of the electron beam is sometimes classified into a low range for 300 kV or less and a medium and high range of more than 300 kV. Since an electron beam in the low range of energy only reaches the surface of the object and the vicinity thereof, the beam is used for surface processing. For example, an electron beam in the low range is used to harden a liquid resin for coating, printing, lamination, magnetic medium processing, integrated circuit board processing, and so forth. Therefore, the electron beam irradiator is not a measuring apparatus.

A large number of measuring devices employing electron beams have already been provided. The measuring devices include an electron microscope, a reflection-type high-energy electron beam diffraction device, a low-energy electron beam diffraction device, and so forth. In each of the measuring devices, an object is put in a high-degree vacuum and the device is required to measure the distribution of angles of scattered electrons from the object and the angles of diffraction electrons therein.

The electron beam irradiator is a processing apparatus that irradiates electrons upon the object to cause a chemical change therein to alter the quality thereof. Therefore, the electron beam irradiator is different from a measuring device that uses the electron beams and measures the intensity distributions of scattered electrons, secondary electrons, diffracted electrons, and so forth.

An electron beam irradiator typically comprises a high DC voltage power supply, an electron gun, an accelerating tube, a scanning horn, an irradiation window, an object conveyor, and a vacuum degassing unit. The high DC voltage power supply is for generating a high voltage necessary to accelerate the electrons, and is made of a Cockcroft-Walton circuit, Delon-Grainahel circuit, Dinamitron DC power supply, or the like. If the current from the high DC power supply is as weak as 1 micro-amp to 1 milli-amp, a van de Graff type supply may be used.

In the electron gun, electricity is applied to a filament in a vacuum to emit thermoelectrons and attract the thermoelectrons toward an anode to separate the thermoelectrons. In the accelerating tube, annular electrodes are juxtaposed and negative voltages are distributed thereto in the direction of the flow of the electrons to vertically accelerate them downward. In the scanning horn, the electrons vertically proceeding downward are subjected to magnetic fields in two directions to cause the electrons to perform scanning motions in two directions.

If the energy of the electron beam in the electron beam irradiator is in the low range, the irradiator may not have the scanning horn. Since an electron beam of very high speed is curved by the scanning horn, the horn needs to have a long proceeding distance for the electron beam. For that reason, if the electron beam irradiator has a scanning horn, the irradiator will be bulky. Since it is difficult to use practically a non- scanning-type electron beam irradiator whose electron beam is in the medium and high range of energy, an electron beam irradiator having an electron beam is in the medium and high range of energy is usually of the scanning type. FIG. 3 shows a schematic view of an electron beam irradiator with a scanning horn.

Since an electron beam irradiator whose electron beam is in the low range of energy is required to be compact, the irradiator is not provided with a scanning horn and is of the non-scanning-type, which is sometimes also called the area type. In such a low energy irradiator, the length of the accelerating tube can also be made small, and the electron beam can be accelerated in some cases by using only a pair of electrodes. Therefore, the accelerating tube. can be made compact.

The interior opening of each of the electron gun, accelerating tube, and scanning horn (which is not provided in some electron beam irradiators) of the electron beam irradiator shown in FIG. 3 are all subject to a high-degree vacuum. A vacuum degassing unit degases the interior opening of each of them to the high-degree vacuum. The irradiation window forms a border between the vacuum and the atmosphere. The interior opening of each of the accelerating tube and the scanning horn is in high-degree vacuum, while the object is placed in the atmosphere. Therefore, the accelerating tube and the scanning horn constitute a vacuum container.

If the scanning horn is provided in the electron beam irradiator, the bottom of the scanning horn has the irradiation window. If the scanning horn is not provided in the electron beam irradiator, the bottom of the accelerator would have the irradiation window. In either case, the irradiation window is formed in the electron beam opening from the vacuum container.

The irradiation window is made of a material that blocks air to maintain the high-degree vacuum but allows the electron beam to pass. Since the electron beam comprises radiation of low penetration power, the thickness of the material must be very small. For that reason, a titanium foil of about 15 to 30 microns in thickness or an aluminum foil of about 30 to 70 microns in thickness is used as the material. The difference between the pressure on the inside of the material and that on the outside is nearly equal to atmospheric pressure because the interior opening of the vacuum container constituted by the accelerating tube and the scanning horn is in the high-degree vacuum and the object is in the atmosphere.

If the irradiation window is of small thickness it will be be deformed into the high-degree vacuum and will be subject to a high degree of tension if the area of the irradiation window is large. The thickness of the material should be made large in order to enable the material to withstand strong tension. If the thickness of the material is large, however, much of the electron beam will be absorbed and a large energy loss will occur. Even if the thickness of the material is small, the electron beam loses some of its energy because each of the electrons is a charged particle of small mass. A thin and durable titanium foil is often used as the material for covering the irradiation window.

An object conveyor carries an object from an inlet port to a position directly beneath the irradiation window, and thereafter carries the processed object to an outlet port. A conveyance mechanism is provided in the base of the conveyor through which X-rays cannot pass. Inlet and outlet port preparation chambers, which are closed by shutters, are provided at the ends of the conveyor. Since X-rays are emitted when the electron beam collides against a substance, it is necessary to block the X-rays.

A conventional device for holding the foil in a scanning type irradiator is described with reference to FIGS. 5 and 6. The irradiation window is provided in the lower portion of a scanning horn 1, which constitutes a part of a vacuum container. The longitudinal section of the scanning horn 1 is shaped as an isosceles trapezoid so that the scanning horn diverges toward the bottom thereof and the front and rear walls of the scanning horn extend in parallel with each other. The distance between the front and rear walls of the scanning horn 1 is small. The side walls of the scanning horn 1 are oblique. In a space defined by the front wall, rear wall, and oblique side walls of the scanning horn 1, an electron beam is scanned by alternating magnetic fields oriented in the longitudinal direction of the cross section of the scanning horn and the direction perpendicular to that longitudinal direction.

A foil 3 is supported at the bottom of the scanning horn 1. The foil 3 is preferably oblong and has its four edges pinched between the top of a foil holder 2 and the bottom of a flange 11 provided on the lower portion of the scanning horn 1. The flange 11 and the foil holder 2 have a large number of bolt holes provided along the periphery of each of the flange and the foil holder and corresponding to each other. Bolts 8 are inserted into the bolt holes and tightened by nuts (not shown in the drawings) or tapped holes provided in the foil holder 2 as shown in the drawings, so that the foil holder 2 and the foil 3 are secured to the flange 11. The top of the foil holder 2 and the bottom of the flange 11 must be parallel so that there is no gap between the foil 3 and each of the flange 11 and the foil holder 2, because it is necessary to subject the inside of the foil to a high-degree vacuum and the outside thereof to the atmosphere to maintain the high-degree vacuum in the scanning horn 1 by the foil.

In the conventional device for holding the foil for the irradiation window it has been particularly troublesome to replace the foil. Since a pressure difference nearly equal to 1 atmosphere acts against the thin foil 3, the foil is subject to a tension force equal to the product of the pressure difference and the area of the foil. When the electron beam passes through the foil 3, much if the energy of the beam is absorbed to generate heat that raises the temperature of the foil. Although cooling air is blown against the bottom (exterior) surface of the foil 3 to cool it, the beam passage area thereof is heated to a high temperature. In other words, the foil 3 is subject to high tension as a result of the pressure differential and also to heat, which fatigues the foil. For that reason, the foil 3 must be replaced every several months. If during te process the foil 3 is broken, the accelerating tube of the electron beam irradiator will no longer be subject to high vacuum and the electrodes of the accelerating tube are likely to be damaged. Therefore, it is necessary to replace the foil 3 without breaking it.

In order to replace the foil 3, a person must enter the irradiation chamber, remove the many bolts 8 (the number of which may be as high as a hundred), remove the old foil and attach a new one to the foil holder 2 by a tape. At that time, it is necessary to attach the new foil under tension to keep the new foil tight. This is difficult work. The foil holder 2 fitted with the new foil is lifted to the flange 11 and coupled thereto by the bolts 8. The foil holder 2 is so heavy that it is very hard for only one person to lift it. Therefore, at least two persons are needed to lift the foil holder 2. It is then necessary to tighten the many bolts 8 again. Therefore, the replacement of the foil 3 is very laborious work and takes much time. For example, it is common to use three persons for 4 to 5 hours each to replace the foil in a conventional unit.

It is required that the force that couples the foil holder 2 to the flange 11 be uniformly applied. If the force is not uniform, the surfaces will not be parallel and a gap will be present at the edge of the foil 3 causing the tension or the foil to be locally increased. For that reason, the tightening torque for each of the bolts 8 must be controlled carefully to be a prescribed level so that the force that couples the foil holder 2 and the flange 11 to each other acts uniformly. It is laborious to control the tightening torque to the required degree on all the bolts 8. Moreover, since such work must be done by the persons in the irradiation chamber, the work can be dangerous. If a plurality of electron beam irradiators are installed in the same irradiation chamber, the operation of all of the irradiators must be stopped when the foil of one is being replaced because ozone or X-rays should be prevented from being generated. Even if the operation of all the electron beam irradiators is stopped, it is still dangerous to enter the irradiation chamber because the chamber will be full of ozone.

SUMMARY OF THE INVENTION

An object of the present invention is a foil holding device for an electron beam irradiator which makes it possible to replace the foil easily and safely.

Another object of the present invention is a foil holding device that makes it possible to replace the foil of the irradiation window of an electron beam irradiator in a relatively short time.

A further object of the present invention is a foil holding device that provides a uniform force to couple a flange to a foil holder of an electron beam irradiator.

These and other objects are accomplished by a mechanism for clamping a foil over an irradiation window of an electron beam irradiator having a vacuum container with a flange on the lower portion thereof, comprising a foil holder for supporting the foil below the flange, a plurality of hanging cylinders for pulling up the foil holder to contact the flange such that the flange and foil holder remain parallel to each other, and a plurality of clamping cylinders for clamping the foil holder to the flange with uniform force around the foil holder.

BRIEF DESCRIPTION OF THE DRAWINGS

The manner by which the above objects, and other objects, features, and advantages of the present invention are attained will be fully apparent from the following detailed description when considered in view of the drawings, wherein.

DETAILED DESCRIPTION

According to the present invention, bolts are not used but a large number of hydraulic cylinder having vertically movable rods are used to secure the foil holder of the electron beam irradiator to the flange thereof. The hydraulic cylinders are juxtaposed along the length of the flange to move the foil holder vertically by the cylinders. The hydraulic cylinders located at the four corners of the flange differ in role and action from the other cylinders in that they are used to make the surfaces of the foil holder and the flange exactly parallel with each other. The other hydraulic cylinders are used to tighten the foil holder firmly with a uniform force.

Figure 1:
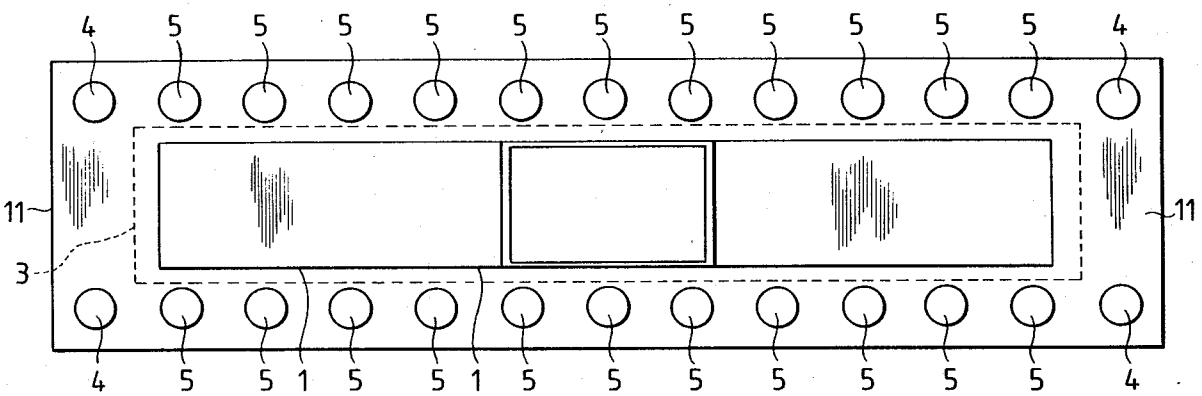
FIG. 1 is a plan view of a scanning horn and the foil holding mechanism of the present invention, which automatically and hydraulically clamps the foil holder of an electron beam irradiator.
Figure 2:
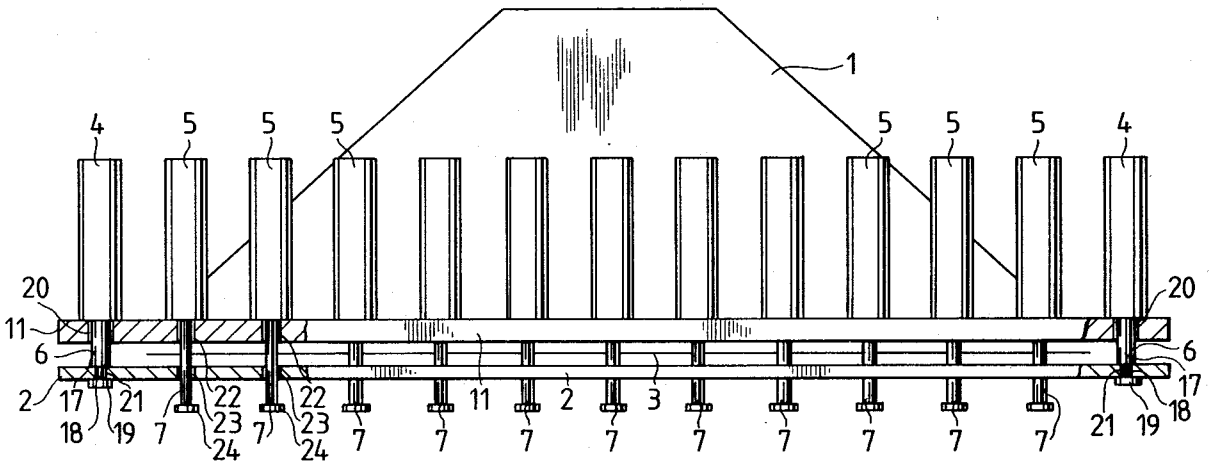
FIG. 2 is an elevational view of the scanning horn and device of FIG. 1.

FIG. 1 shows a plan view of a scanning horn 1 provided with a mechanism of the present invention for automatically and hydraulically clamping the foil holder 2 of the electron beam irradiator. FIG. 2 shows an elevational view of the scanning horn 1. An irradiation window is centrally provided in the lower portion of the scanning horn 1, which constitutes a part of a vacuum container. The longitudinal section of the scanning horn 1 is shaped as an isosceles trapezoid so that the side walls of the scanning horn are oblique as in a conventional scanning horn. A window foil 3 is fitted on the bottom of a flange 11 provided on the lower portion of the scanning horn 1, and is held by the foil holder 2.

Hydraulic hanging cylinders 4 having pull-up rods 6 extending down from the cylinders and movable up and down are attached to the four corners of the flange 11 to hold the window foil 3 by the foil holder 2. Each of the pull-up rods 6 comprises a large-diameter portion 17, a small-diameter portion 18, and a pushing portion 19. The flange 11 and the foil holder 2 have insertion holes 20 and 21, respectively, through which the pullup rods 6 extend. The diameter of each of the insertion holes 20 of the flange 11 is larger than that of the pull-up rod 6. The pull-up rods 6 are movable relative to the insertion holes 20 of the flange 11. Although the small-diameter portions 18 of the pull-up rods 6 extend through the insertion holes 21 of the foil holder 2, the large-diameter portions 17 and pushing portions 19 of the pull-up rods cannot extend through the insertion holes. The foil holder 2 is pinched between the large-diameter portions 17 and pushing portions 19 of the pull-up rods 6 so that the foil holder and the pull-up rods are moved together.

Hydraulic clamping cylinders 5 having clamping rods 7, which extend down from the cylinders and are movable up and down, are provided along both the long side edges of the flange 11 between the hanging cylinders 4 to hold the window foil 3 by the foil holder 2. The clamping rods 7 extend through insertion holes 22 of the flange 11 and insertion holes 23 of the foil holder 2, and are provided with small flanges 24, the diameter of each of which is larger than that of the insertion hole 23. The number of the clamping rods 7 is chosen to be sufficiently large such that the contact pressure of the foil holder 2 on the flange 11 is uniform over the whole contact surface. The hanging cylinders 4 are used to pull up the foil holder 2, while the clamping cylinders 5 are used to firmly clamp the foil holder after it is pulled up by the hanging cylinders.

The pull-up rods 6 of the four hanging cylinders 4 are moved up at the same speed. The reason for this is that if the pull-up rods 6 were not moved up at the same speed, the foil holder 2 would be slightly obliquely secured to the flange 11. Even if oil pressure is applied from the same oil pressure source to the hanging cylinders 4, it would be difficult to make the ascending speeds of the rods of all the hanging cylinders exactly equal to each other.

Figure 4:
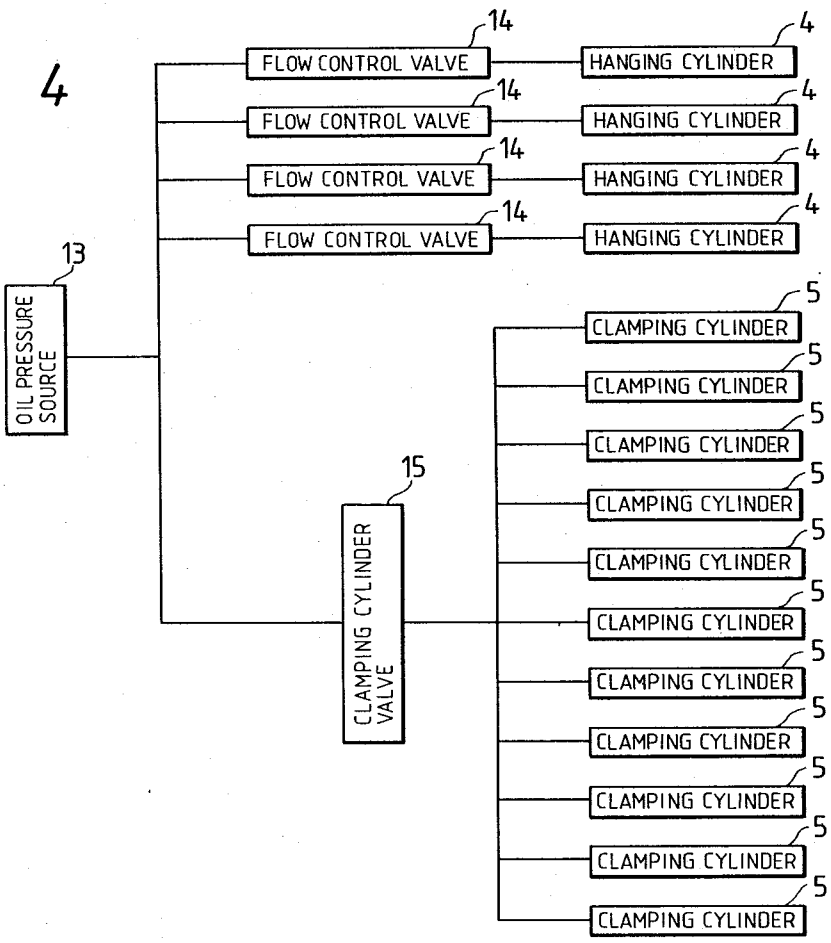
FIG. 4 is a diagram of the oil pressure application system of the foil holding mechanism of FIG. 1.
Figure 3:
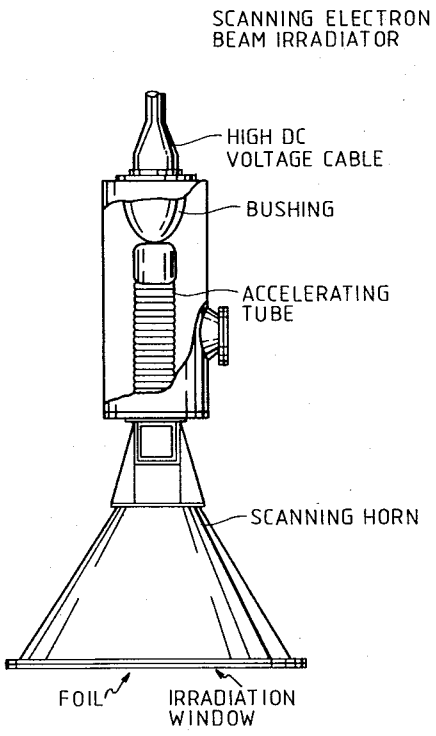
FIG. 3 is a front view of an electron beam irradiator of the scanning type.
Figure 5:
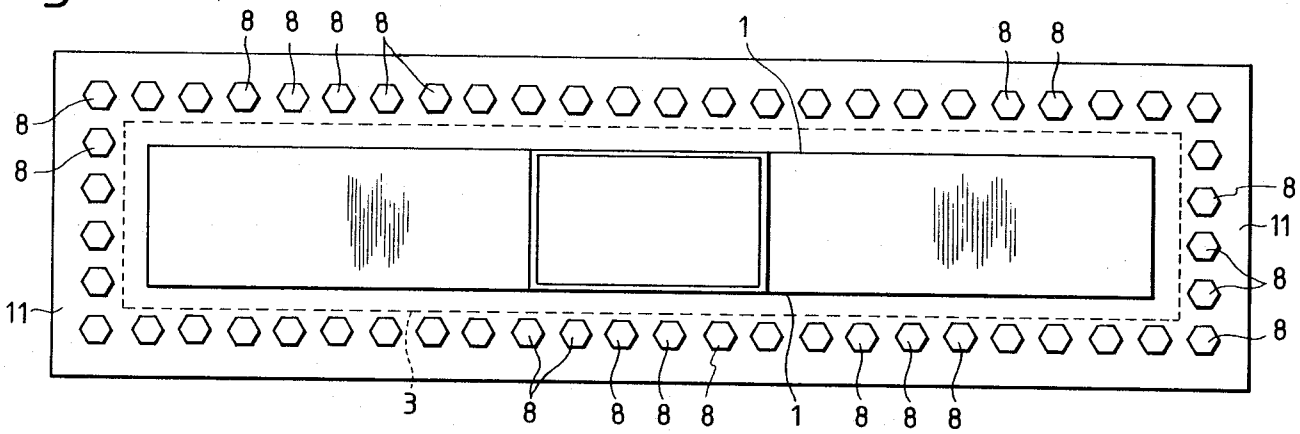
FIG. 5 is a plan view of a scanning horn provided with a conventional foil holding device.
Figure 6:
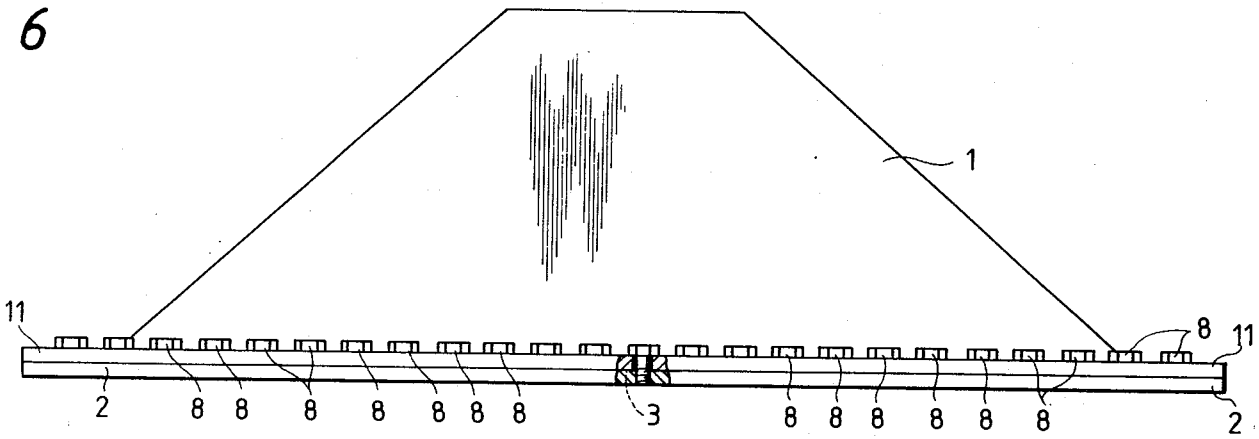
FIG. 6 is a front view of the scanning horn of FIG. 5 provided with the conventional foil holding device.

In order to eliminate this difficulty, an oil pressure application system shown in FIG. 4 is provided. The oil pressure is applied from the oil pressure source 13 to the four hanging cylinders 4 through flow control valves 14. The degree of opening of each of the flow control valves 14 is individually adjusted so that the flow rates of oil to the hanging cylinders 4 are equal to each other. As a result, the ascending speeds of the rods 6 of the four hanging cylinders 4 are made equal to each other. It is not necessary to make the ascending speeds of the clamping rods 7 of the clamping cylinders 5 equal to each other, but it is necessary to make their clamping forces equal to each other. The clamping rods 7 of the clamping cylinders 5 are moved by opening or closing a single clamping cylinder valve 15.

The window foil 3 may be replaced with a new one by the following procedure as described below. The application of the oil pressure to the hanging cylinders 4 and the clamping cylinders 5 is stopped first so that the cylinders lose their upward pulling forces. The foil holder 2 then falls under the force of gravity. The old foil 3 is removed from the foil holder 2. The new foil is placed in the space between the foil holder 2 and the flange 11, as shown in FIG. 2. The oil pressure is thereafter applied to the hanging cylinders 4 so that the pull-up rods 6 are moved up at the same speed. As a result, the foil holder 2 is moved toward the flange 11 while the elements remain parallel to each other. The new foil 3 is pinched between the foil holder 2 and the flange 11.

O-rings or other seals (not shown) are interposed between the foil 3 and the foil holder 2 and between the foil 3 and the flange 11. The foil holder 2, the foil 3, and the flange 11 are brought into contact with each other. The oil pressure is applied to all the clamping cylinders 5 so that the clamping rods 7 are simultaneously moved up. The small flanges 24 at the tips of the clamping rods 7 push the foil holder 2 upward. Since the oil pressure is equal for all the clamping cylinders 5, the clamping forces thereof are equal to each other. The clamping power of the clamping cylinders 5 is thus made more uniform than that of bolts and the clamping torque for each cylinder is controlled to the same level.

Although in the conventional device the clamping torque for each of the bolts and the clamping force of each of the bolts are proportional to each other, the constant of the proportion is not equal for all the bolts because of frictional forces. For that reason, even if the magnitudes of clamping torque for all of the bolts are equal to each other, the clamping forces thereof are not necessarily equal to each other because of the angle of obliqueness of the screw of each bolt and the frictional force thereon. According to the present invention, however, the equal oil pressure is applied to all the clamping cylinders 5 so that the clamping forces thereof are equal to each other.

In order to keep the flange 11, the foil 3, and the foil holder 2 clamped together, the application of the oil pressure to the clamping cylinders 5 is continued.

The foil 3 is preferably cut off to be slightly larger in size than the opening of the scanning horn 1 and is secured between the flange 11 and the foil holder 2 in the embodiment. The present invention, however, is not confined in this manner such that a tape-like long foil wound on a roller may be fed forward along the bottom of the scanning horn. In such an embodiment, no person is required to enter into the irradiation chamber to attach and detach the foil and complete automation is attained.

By practicing the present invention, it is not necessary to perform troublesome operations such as the attachment and detachment of bolts. The foil replacement work is thus made very easy and the time which it takes to do the foil replacement work is shortened. Since it is not necessary to lift the heavy foil holder manually, only one person is required to replace the foil. Moreover, since the time that it takes to replace the foil is shortened, the period for which the person is in the irradiation chamber is also shortened to reduce the exposure to ozone.

In the present invention, since the foil holder is pulled up at the same speed for all the portions thereof by the four hanging cylinders, the foil holder and the flange are kept parallel with each other. Also, since the foil holder is clamped by many clamping cylinders exerting equal clamping forces, the foil holder is uniformly clamped.

What is claimed is:

1. A mechanism for clamping a foil over an irradiation window of an electron beam irradiator having a vacuum container with a flange on the lower portion thereof, comprising:

a foil holder for supporting the foil below the flange;

a plurality of hanging cylinders for pulling up said foil holder into contact with said flange such that the flange and said foil holder remain parallel to each other during the movement of the foil holder; and a plurality of clamping cylinders for clamping said foil holder to said flange with the edges of the foil therebetween and with uniform force being applied around said foil holder.

2. A mechanism according to claim 1, further including hydraulic control means for supplying pressurized fluid to each of said hanging cylinders at a substantially equal flow rate such that said foil holder is maintained parallel to the flange as said hanging cylinders pull said foil to contact the flange.

3. A mechanism according to claim 2, wherein said hydraulic control means comprises:

a source of pressurized fluid;

a clamping cylinder valve for supplying said pressurized fluid to each of said clamping cylinders; and a plurality of hanging cylinder flow control valves, each of said hanging cylinder flow control valves being connected to said source of pressurized fluid and to a different one of said hanging cylinders to supply pressurized fluid to the hanging cylinders to maintain the rates of movement of said hanging cylinders equal to each other.

* * * * *